US012485476B2

(12) United States Patent
Aizawa et al.

(10) Patent No.: US 12,485,476 B2
(45) Date of Patent: Dec. 2, 2025

(54) CASTING SYSTEM

(71) Applicants: TPR CO., LTD., Tokyo (JP); TPR INDUSTRY CO., LTD., Sagae (JP)

(72) Inventors: Hideki Aizawa, Sagae (JP); Takeshi Takita, Sagae (JP); Kazuhiko Oizumi, Sagae (JP)

(73) Assignees: TPR CO., LTD., Tokyo (JP); TPR INDUSTRY CO., LTD., Sagae (JP)

( * ) Notice: Subject to any disclaimer, the term of this patent is extended or adjusted under 35 U.S.C. 154(b) by 164 days.

(21) Appl. No.: 18/363,308

(22) Filed: Aug. 1, 2023

(65) Prior Publication Data

US 2023/0381855 A1 Nov. 30, 2023

Related U.S. Application Data

(63) Continuation of application No. PCT/JP2021/004586, filed on Feb. 8, 2021.

(51) Int. Cl.
*B22D 13/10* (2006.01)
*B22D 13/12* (2006.01)

(52) U.S. Cl.
CPC ..... *B22D 13/10* (2013.01); *B22D 13/12* (2013.01)

(58) Field of Classification Search
CPC ..... B22D 13/10; B22D 13/105; B22D 13/12
USPC ..... 164/114, 118, 272, 286, 289, 290, 296, 164/297
See application file for complete search history.

(56) References Cited

U.S. PATENT DOCUMENTS

2003/0234095 A1* 12/2003 Usui ..... B22D 46/00 164/336
2008/0157020 A1* 7/2008 Rose et al. ..... B22D 41/26 251/326
2017/0209921 A1* 7/2017 Nishida et al. ..... B22D 41/12
2017/0225226 A1 8/2017 Yukiyoshi et al.
2017/0326636 A1 11/2017 Tadashi et al.

FOREIGN PATENT DOCUMENTS

JP H08-117973 A 5/1996
JP 2003230948 A 8/2003
JP 4334177 B 9/2009
JP 2016198813 A 12/2016
WO 2016084154 A 6/2016

OTHER PUBLICATIONS

Patent Cooperation Treaty, International Search Report, Application No. PCT/JP2021/004586, dated Mar. 9, 2021, in 4 pages.

* cited by examiner

*Primary Examiner* — Kevin P Kerns
(74) *Attorney, Agent, or Firm* — PROCOPIO, CORY, HARGREAVES & SAVITCH LLP

(57) ABSTRACT

A casting system (10) includes a plurality of mold tables (41 and 42), molten metal pouring trucks (21 and 22), and a molten metal supply furnace (30). The mold tables are each provided with centrifugal casting molds (81 to 84 and 91 to 94). Each molten metal pouring truck can move to the position of each mold table and pour molten metal into the molds installed on the mold table. The molten metal supply furnace supplies molten metal to the molten metal pouring trucks.

10 Claims, 10 Drawing Sheets

CASTING SYSTEM

CROSS-REFERENCE TO RELATED APPLICATION

The present application is a bypass continuation application based on and claims the benefit of priority from PCT Application No. PCT/JP2021/004586 filed Feb. 8, 2021, the entire contents of which are incorporated herein by reference.

TECHNICAL FIELD

The present disclosure relates to a casting system.

BACKGROUND ART

A conventional casting system is disclosed in Patent Literature 1 below. The casting system is configured to shape a cylindrical cast by centrifugal casting and includes a cylindrical mold for centrifugal casting, a molten metal pouring device, and a work unit. The molten metal pouring device is disposed at one end part of the mold in a center axial direction and pours molten metal into the mold from the one end part of the mold. The work unit includes a device configured to pull out the cast from the mold, a device configured to clean the mold from which the cast is pulled out, and a device configured to apply mold wash to the cleaned mold. After the mold wash is applied to the mold, the molten metal pouring device pours molten metal into the mold again.

CITATION LIST

Patent Literature

Patent Literature 1: Japanese Patent No. 4334177

SUMMARY OF INVENTION

Technical Problem

In the casting system disclosed in Patent Literature 1, there is no work to be performed by the molten metal pouring device until removal of the cast, cleaning of the mold, and mold wash application to the mold are completed once the molten metal pouring device pours molten metal into the mold. This causes decrease in the operation rate of the molten metal pouring device, thereby degrading the efficiency of cast production.

The present invention is intended to provide a casting system that can improve the efficiency of production.

Solution to Problem

A casting system according to an aspect of the present disclosure includes a plurality of mold tables, a molten metal pouring device, and a molten metal supply furnace. The mold tables are each provided with at least one centrifugal casting mold. The molten metal pouring device can move to the position of each of the plurality of mold tables and pour molten metal into the mold installed on the mold table. The molten metal supply furnace supplies molten metal to the molten metal pouring device.

With this configuration, since the molten metal pouring device can pour molten metal into the mold disposed on each of the plurality of mold tables, the operation rate of the molten metal pouring device can be improved. Accordingly, productivity can be improved.

The above-described casting system preferably further includes a plurality of unit devices provided for the plurality of respective mold tables, and each of the unit devices preferably includes at least one of a mounting-demounting unit configured to perform mounting and demounting of a lid member mounted at an end part of each of the molds, a removal unit configured to pull out a cast shaped inside the mold from the mold, a cleaning unit configured to clean the mold, and a lining unit configured to apply mold wash to the mold.

With this configuration, since at least one work among mounting and demounting of the lid member of the mold, removal of the cast, cleaning of the mold, and mold wash application to the mold can be performed by the unit device, productivity can be further improved.

In the above-described casting system, the mold tables are preferably rotatable, and, on each of the mold tables, a plurality of the molds are preferably disposed at different positions in a rotational direction of the mold table such that when a certain mold is positioned to be able to face the molten metal pouring device, a mold different from the certain mold can face the unit devices.

Specifically, in the above-described casting system, each of the mold tables is preferably sandwiched between a movement region of the molten metal pouring device and a corresponding one of the unit devices, and on each of the mold tables, the molds are preferably disposed at respective positions shifted by 180° from each other in the rotational direction.

With this configuration, when the molten metal pouring device pours molten metal into a mold disposed at a predetermined position on each mold table, the corresponding unit device can perform various work on a mold disposed at a position different from the predetermined position on the mold table, and thus productivity can be further improved.

In the above-described casting system, on each of the mold tables, a plurality of the molds are preferably disposed at respective different positions in the rotational direction, and the molten metal pouring device preferably includes a plurality of molten metal pouring units that can simultaneously pour molten metal into the plurality of respective molds.

With this configuration, since molten metal can be simultaneously poured into the plurality of molds by the plurality of molten metal pouring units provided at the molten metal pouring device, productivity can be further improved.

The above-described casting system preferably further includes a conveyance device configured to convey the casts pulled out by the removal units of the unit devices.

With this configuration, the casts can be easily conveyed to postprocessing.

The above-described casting system preferably further includes an outer wall part provided around the mold tables, the unit devices, and the conveyance device, and an inner wall part provided between the plurality of mold tables inside the outer wall part.

With this configuration, worker safety can be easily ensured. Moreover, safety is ensured and thereby, even when maintenance or the like is performed on one mold table, another mold table partitioned by the inner wall part can be operated, and thus productivity can be improved.

The above-described casting system preferably includes a plurality of the molten metal pouring devices, and one of the plurality of molten metal pouring devices preferably pours molten metal into each of the molds provided on the plurality of mold tables.

With this configuration, maintenance or the like can be performed on a molten metal pouring device not performing work of pouring molten metal into molds. Accordingly, cast shaping can be continuously performed by periodically interchanging a molten metal pouring device performing work of pouring molten metal into molds with a molten metal pouring device on which maintenance is completed.

The above-described casting system preferably further includes a plurality of cooling devices provided opposite a plurality of respective mold tables and configured to cool the molds provided on the mold tables by cooling water.

With this configuration, since mold cooling can be performed at the mold tables, productivity can be further improved.

In the above-described casting system, the mold tables are preferably provided with roller devices configured to rotate the molds, and the above-described casting system preferably further includes a control unit configured to control rotational speeds of the roller devices.

With this configuration, for example, the rotational speeds can be controlled for each mold, and thus multiple kinds of casts can be manufactured.

DESCRIPTION OF EMBODIMENT

Figure 1:
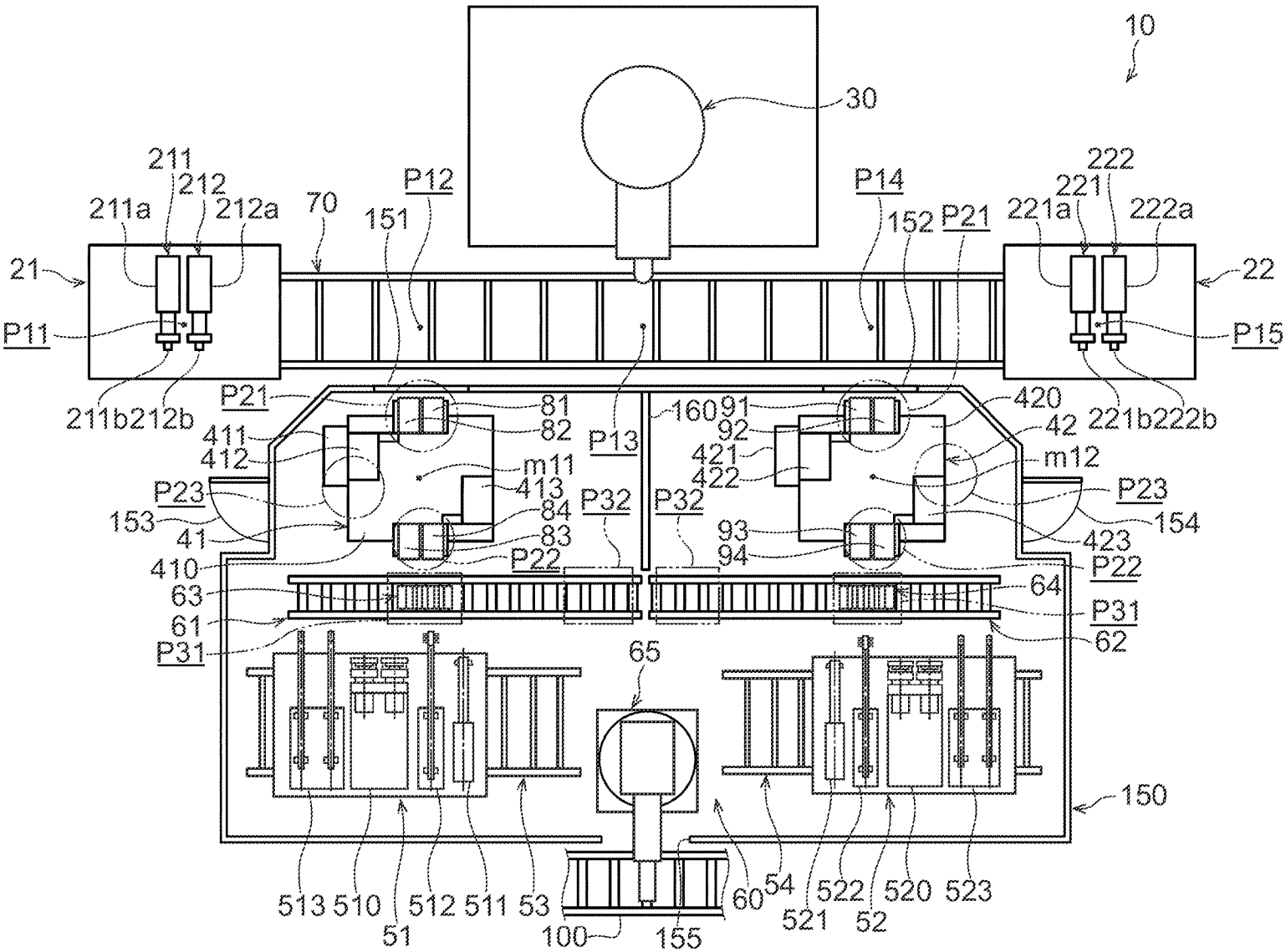
FIG. 1 is a plan view schematically illustrating a planar structure of a casting system of an embodiment.

An embodiment of a casting system will be described below with reference to the accompanying drawings. To facilitate understanding of the description, any identical constituent components in the drawings are denoted by the same reference sign when possible, and duplicate description thereof is omitted.

A casting system 10 illustrated in FIG. 1 is a system configured to manufacture, for example, a cylinder liner of an engine, more specifically, a wet liner by a centrifugal casting method. The casting system 10 includes molten metal pouring trucks 21 and 22, a molten metal supply furnace 30, mold tables 41 and 42, unit trucks 51 and 52, conveyers 61 and 62, pallets 63 and 64, and a robot device 65. In the present embodiment, the molten metal pouring trucks 21 and 22 each correspond to a molten metal pouring device, and the unit trucks 51 and 52 each correspond to a unit device. The conveyers 61 and 62, the pallets 63 and 64, and the robot device 65 constitute a conveyance device 60.

The first molten metal pouring truck 21 is provided on a straight rail 70 and travels on the rail 70 based on power of a built-in motor. The first molten metal pouring truck 21 includes two molten metal pouring units 211 and 212. The molten metal pouring units 211 and 212 include pot parts 211*a* and 212*a* and spout parts 211*b* and 212*b*, respectively. The pot parts 211*a* and 212*a* are parts into which molten metal is poured from the molten metal supply furnace 30. The spout parts 211*b* and 212*b* are parts that actually pour molten metal into molds 81 to 84 provided on the mold table 41 and into molds 91 to 94 provided on the mold table 42.

A first waiting position P11, a first molten metal pouring position P12, a molten metal receiving position P13, a second molten metal pouring position P14, and a second waiting position P15 are sequentially set on the rail 70 from a left end part toward a right end part.

The first waiting position P11 is a position at which the first molten metal pouring truck 21 waits. The second waiting position P15 is a position at which the second molten metal pouring truck 22 waits.

The first molten metal pouring position P12 is a position at which the first molten metal pouring truck 21 faces the first mold table 41. When the first molten metal pouring truck 21 is positioned at the first molten metal pouring position P12, the spout parts 211*b* and 212*b* of the molten metal pouring units 211 and 212 can pour molten metal into the molds 81 to 84 of the first mold table 41.

The molten metal receiving position P13 is a position at which the first molten metal pouring truck 21 faces the molten metal supply furnace 30. When the first molten metal pouring truck 21 is positioned at the molten metal receiving position P13, molten metal can be supplied from the molten metal supply furnace 30 to the pot parts 211*a* and 212*a* of the molten metal pouring units 211 and 212.

The second molten metal pouring position P14 is a position at which the first molten metal pouring truck 21 faces the second mold table 42. When the first molten metal pouring truck 21 is positioned at the second molten metal pouring position P14, molten metal can be poured from the spout parts 211*b* and 212*b* of the molten metal pouring units 211 and 212 into the molds 91 to 94 of the second mold table 42.

The second molten metal pouring truck 22 has the same configuration as the first molten metal pouring truck 21. Specifically, the second molten metal pouring truck 22 is provided on the rail 70 and includes two molten metal pouring units 221 and 222. The molten metal pouring units 221 and 222 include pot parts 221*a* and 222*a* and spout parts 221*b* and 222*b*, respectively. The second molten metal pouring truck 22 can move to the first molten metal pouring position P12, the molten metal receiving position P13, and the second molten metal pouring position P14 on the rail 70. The second molten metal pouring truck 22 cannot move to the first waiting position P11 but can move to the second waiting position P15 at the right end part of the rail 70.

In the casting system 10, in a duration in which any one of the molten metal pouring trucks 21 and 22 is operational on the rail 70, the other of the molten metal pouring trucks 21 and 22 waits at the waiting position P11 or P15. For example, in a duration in which the first molten metal pouring truck 21 is operational on the rail 70, the second molten metal pouring truck 22 waits at the second waiting position P15. In this duration, a worker can perform various kinds of maintenance on the molten metal pouring units 221 and 222 of the second molten metal pouring truck 22. After the molten metal pouring units 211 and 212 of the first molten metal pouring truck 21 pour molten metal to the molds 81 to 84 and 91 to 94 a predetermined number of times, the first molten metal pouring truck 21 moves to the first waiting position P11 and the second molten metal pouring truck 22 becomes operational. In this case, the worker can perform various kinds of maintenance on the molten metal pouring units 211 and 212 of the first molten metal pouring truck 21 having moved to the first waiting position P11.

The molten metal supply furnace 30 pours molten metal into the pot parts 211*a* and 212*a* of the molten metal pouring units 211 and 212 of the first molten metal pouring truck 21 when the first molten metal pouring truck 21 is positioned at the molten metal receiving position P13. Similarly, the molten metal supply furnace 30 pours molten metal into the pot parts 221*a* and 222*a* of the molten metal pouring units 221 and 222 of the second molten metal pouring truck 22 when the second molten metal pouring truck 22 is positioned at the molten metal receiving position P13.

The first mold table 41 includes a rotational mount 410, a drive unit 411, and roller devices 412 and 413.

Figure 2:
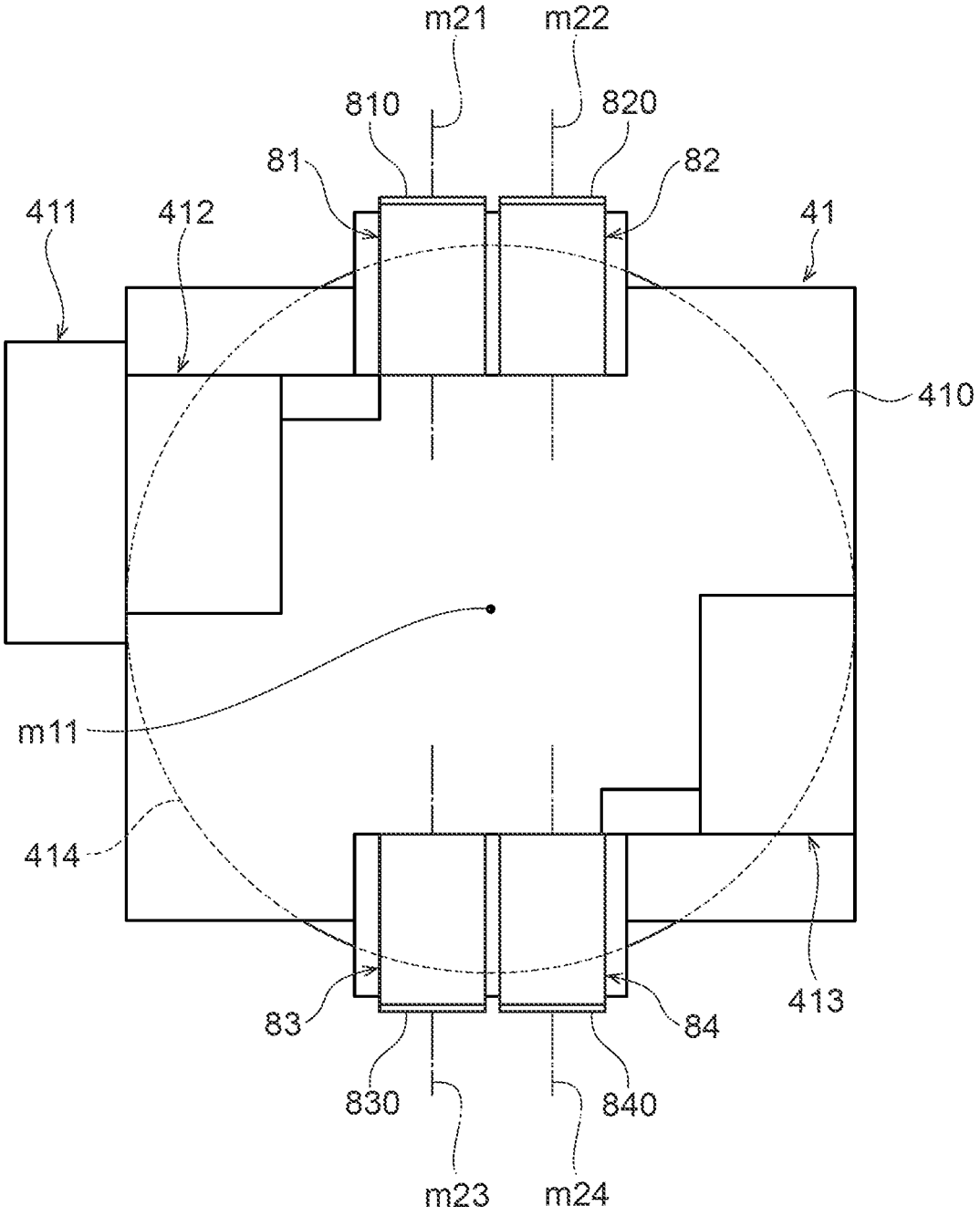
FIG. 2 is a plan view schematically illustrating a planar structure of a mold table of the embodiment.

As illustrated in FIG. 2, the rotational mount 410 is formed in a rectangular shape. The rotational mount 410 is installed to be rotatable about an axis line m11 passing through the center thereof. The molds 81 and 82 are installed in a pair along one side of the rotational mount 410, and the molds 83 and 84 are installed in a pair along another side opposite to the one side.

The molds 81 to 84 are disposed such that central axes m21 to m24 thereof point outward in a radial direction with respect to the axis line m11. The molds 81 and 82 and the molds 83 and 84 are disposed at different positions in a rotational direction of the first mold table 41, more specifically, at positions shifted by 180° from each other in the rotational direction of the first mold table 41. A lid member 810 is attached in a demountable manner to one end part positioned outside in the radial direction with respect to the axis line m11 among both end parts of the mold 81. Similarly, lid members 820, 830, and 840 are each attached in a demountable manner to one end part of the corresponding one of the molds 82 to 84.

Hereinafter, the paired molds 81 and 82 are also referred to as a "first pair of molds 81 and 82", and the paired molds 83 and 84 are also referred to as a "second pair of molds 83 and 84".

Figure 3:
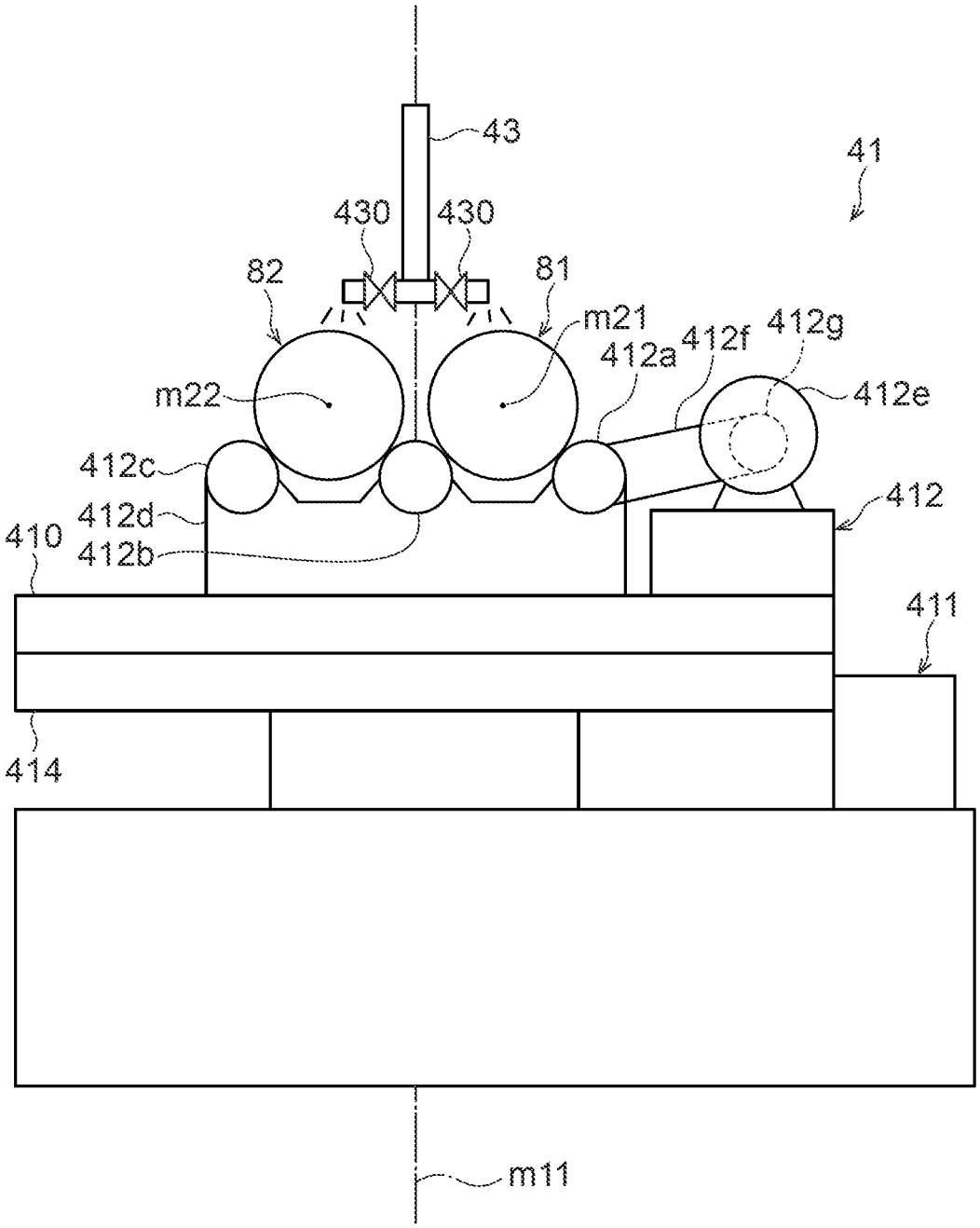
FIG. 3 is a side view schematically illustrating a side structure of the mold table of the embodiment.

As illustrated in FIG. 3, a disk unit 414 formed in a circular plate shape about the axis line m11 is integrally fixed to a bottom surface of the rotational mount 410. The drive unit 411 is disposed in contact with part of the circumference of the disk unit 414. The drive unit 411 is made of a motor and transfers its power to the disk unit 414, thereby applying torque to the disk unit 414 and rotating the disk unit 414 about the axis line m11. As the disk unit 414 rotates, the rotational mount 410 integrally fixed to the disk unit 414 rotates about the axis line m11 as well. Accordingly, the positions of the first pair of molds 81 and 82 and the second pair of molds 83 and 84 can be displaced in a rotational direction with respect to the axis line m11.

Hereinafter, as illustrated in FIG. 1, on the first mold table 41, a rotational position at which the first pair of molds 81 and 82 are positioned on the first mold table 41 is referred to as a "molten metal pouring position P21", and a rotational position at which the second pair of molds 83 and 84 are positioned on the first mold table 41 is referred to as a "mounting-demounting position P22". In addition, a position shifted anticlockwise by 90° from the molten metal pouring position P21 on the first mold table 41 is referred to as a "maintenance position P23". The maintenance position P23 is a position used when the molds 81 to 84 placed on the first mold table 41 are replaced to change the kind of cast.

The roller device 412 illustrated in FIG. 3 is a device for rotating the molds 81 and 82. The roller device 412 includes rotational units 412*a* to 412*c*, a base 412*d*, and a drive unit 412*e*.

The base 412*d* is fixed to an upper surface of the rotational mount 410. The rotational units 412*a* to 412*c* are rotatably provided on an upper surface of the base 412*d*.

Each of the rotational units 412*a* to 412*c* is formed in a substantially barbell shape and has a structure in which a disk member having an outer diameter larger than a shaft member having a bar shape is provided at each end of the shaft member. The rotational units 412*a* to 412*c* are disposed alongside such that central axes thereof are parallel to one another. The rotational units 412*a* to 412*c* are disposed at a predetermined interval in a direction orthogonal to the central axes thereof. The one mold 81 is disposed between the rotational units 412*a* and 412*b* in contact with their outer peripheral surfaces. The other mold 82 is disposed between the rotational units 412*b* and 412*c* in contact with their outer peripheral surfaces.

The drive unit 412*e* is made of a motor and transfers its power to the rotational unit 412*a* through a pulley 412*g* and a toothed belt 412*f*, thereby applying torque to the rotational unit 412*a* and rotating the rotational unit 412*a*. As the rotational unit 412*a* rotates, the mold 81, the rotational unit 412*b*, the mold 82, and the rotational unit 412*c* rotate accordingly. As a result, the molds 81 and 82 can be rotated.

As illustrated in FIG. 3, the casting system 10 further includes a cooling device 43 disposed above the first mold table 41. The cooling device 43 is disposed above and opposite the first pair of molds 81 and 82. The cooling device 43 rotates integrally with the rotational mount 410 while maintaining the state of being positioned above the first pair of molds 81 and 82. The cooling device 43 cools the first pair of molds 81 and 82 disposed on the first mold table 41 by spraying cooling water to the first pair of molds 81 and 82. The cooling device 43 includes an electromagnetic valve 430 capable of performing switching between spray of cooling water to the first pair of molds 81 and 82 and stop of the spray. A time in which cooling water is sprayed from the cooling device 43 to the first pair of molds 81 and 82, in other words, a cooling time of the first pair of molds 81 and 82 can be adjusted by controlling an opening-closing time of the electromagnetic valve 430.

The first mold table 41 is provided with another cooling device 43 opposite the second pair of molds 83 and 84. Accordingly, one cooling device 43 disposed above and opposite the first pair of molds 81 and 82 and the other cooling device 43 disposed opposite the second pair of molds 83 and 84 are individually provided at the first mold table 41.

As illustrated in FIG. 1, the roller device 413 is a device for rotating the molds 83 and 84. The roller device 413 has a structure identical or similar to that of the roller device 412 illustrated in FIG. 3, and thus detailed description thereof is omitted.

The second mold table 42 has the same structure as the first mold table 41. Specifically, the second mold table 42 includes a rotational mount 420, a drive unit 421, and roller devices 422 and 423. A first pair of molds 91 and 92 and a second pair of molds 93 and 94 are installed on an upper surface of the rotational mount 420. The rotational mount 420 rotates about an axis line m12. A cooling device identical or similar to the cooling device 43 illustrated in FIG. 3 is disposed at the second mold table 42. The configurations of these elements are identical or similar to the configurations of the corresponding elements of the first mold table 41, and thus detailed description thereof is omitted.

As illustrated in FIG. 1, in the casting system 10, the first unit truck 51 is disposed on a side opposite the rail 70 with respect to the first mold table 41, and the second unit truck 52 is disposed on a side opposite the rail 70 with respect to the second mold table 42. The first conveyer 61 is disposed between the first mold table 41 and the first unit truck 51, and the second conveyer 62 is disposed between the second mold table 42 and the second unit truck 52. The conveyers 61 and 62 are formed in parallel to the rail 70.

The first unit truck 51 is disposed on a rail 53. The rail 53 is formed in parallel to the first conveyer 61. The first unit truck 51 can move on the rail 53 with power of a built-in motor.

Figure 4:
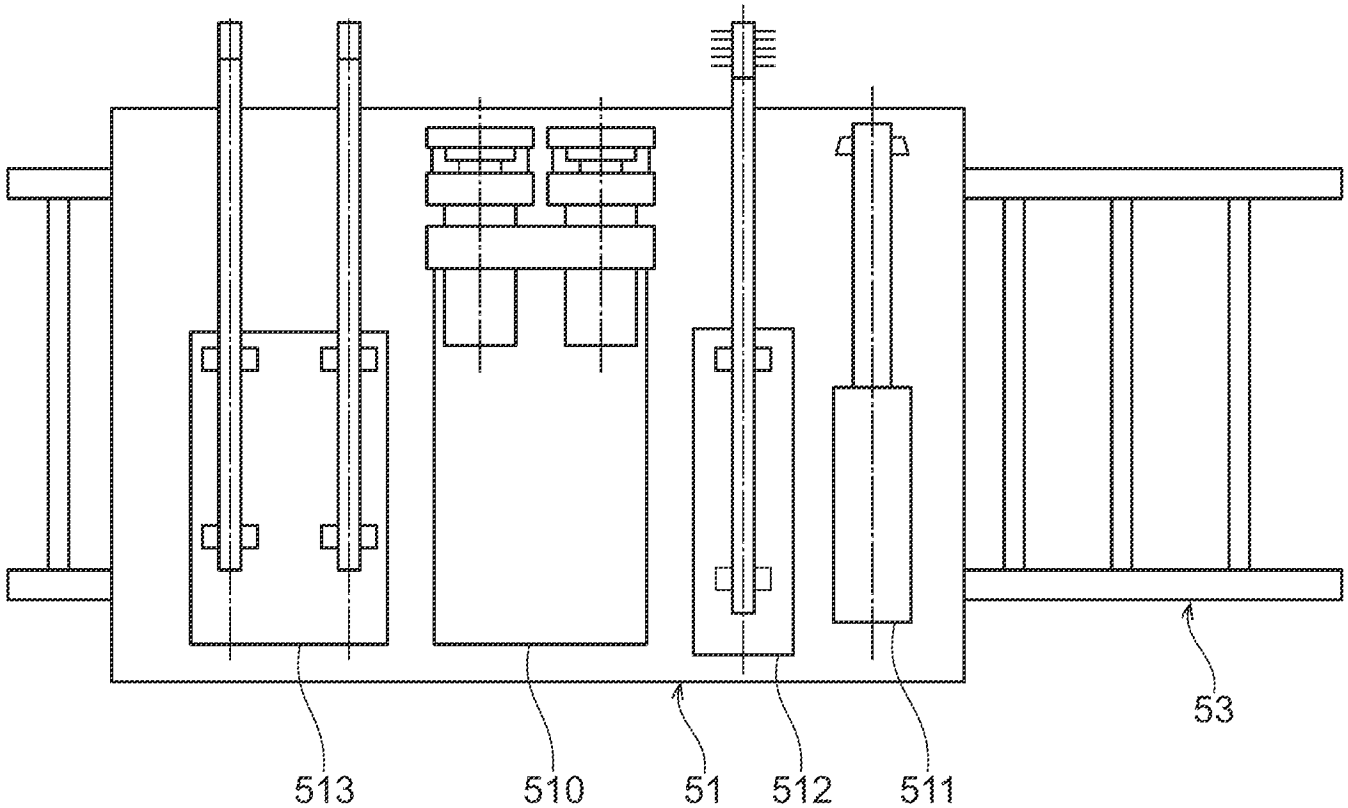
FIG. 4 is a plan view schematically illustrating a planar structure of a unit truck of the embodiment.

As illustrated in FIG. 4, the first unit truck 51 includes a mounting-demounting device 510, a removal device 511, a cleaning device 512, and a lining device 513. In the present embodiment, the mounting-demounting device 510, the removal device 511, the cleaning device 512, and the lining device 513 correspond to a mounting-demounting unit, a removal unit, a cleaning unit, and a lining unit, respectively.

The mounting-demounting device 510 is a device for performing demounting of the lid members 810, 820, 830, and 840 from the molds 81 to 84 installed on the first mold table 41 and mounting of the lid members 810, 820, 830, and 840 on the molds 81 to 84. The mounting-demounting device 510 can simultaneously perform mounting and demounting of the lid members of a pair of molds positioned at the mounting-demounting position P22 on the first mold table 41. For example, as illustrated in FIG. 1, when the second pair of molds 83 and 84 are positioned at the mounting-demounting position P22 on the first mold table 41, the mounting-demounting device 510 can simultaneously perform mounting and demounting of the lid members 830 and 840 of the respective molds 83 and 84.

The removal device 511 is a device for removing casts from inside the molds 81 to 84 installed on the first mold table 41. For example, as illustrated in FIG. 1, when the second pair of molds 83 and 84 are positioned at the mounting-demounting position P22 on the first mold table 41, the removal device 511 sequentially pulls out casts from inside the respective molds 83 and 84.

The cleaning device 512 is a device for cleaning inside the molds 81 to 84 installed on the first mold table 41 by using a brush or the like. For example, as illustrated in FIG. 1, when the second pair of molds 83 and 84 are positioned at the mounting-demounting position P22 on the first mold table 41, the cleaning device 512 sequentially cleans inside each of the molds 83 and 84.

The lining device 513 is a device for applying mold wash inside the molds 81 to 84 installed on the first mold table 41. For example, as illustrated in FIG. 1, when the second pair of molds 83 and 84 is positioned at the mounting-demounting position P22 on the first mold table 41, the lining device 513 simultaneously applies mold wash inside each of the molds 83 and 84.

The first unit truck 51 moves on the rail 53 and performs positioning of each of the mounting-demounting device 510, the removal device 511, the cleaning device 512, and the lining device 513 with respect to a pair of molds disposed at the mounting-demounting position P22 on the first mold table 41. Any process among mounting and demounting of a lid member, cast removal, mold cleaning, and mold wash application to a mold is performed when a device positioned with respect to the pair of molds disposed at the mounting-demounting position P22 on the first mold table 41 among the mounting-demounting device 510, the removal device 511, the cleaning device 512, and the lining device 513 drives.

As illustrated in FIG. 1, the second unit truck 52 has the same configuration as the first unit truck 51. Specifically, the second unit truck 52 is disposed on a rail 54 and includes a mounting-demounting device 520, a removal device 521, a cleaning device 522, and a lining device 523. The configurations of these elements are identical or similar to the configurations of the corresponding elements of the first unit truck 51, and thus detailed description thereof is omitted.

The conveyance device 60 includes the conveyers 61 and 62, the pallets 63 and 64, and the robot device 65.

The first pallet 63 and the second pallet 64 are movably placed on the first conveyer 61 and the second conveyer 62, respectively.

Figure 5:
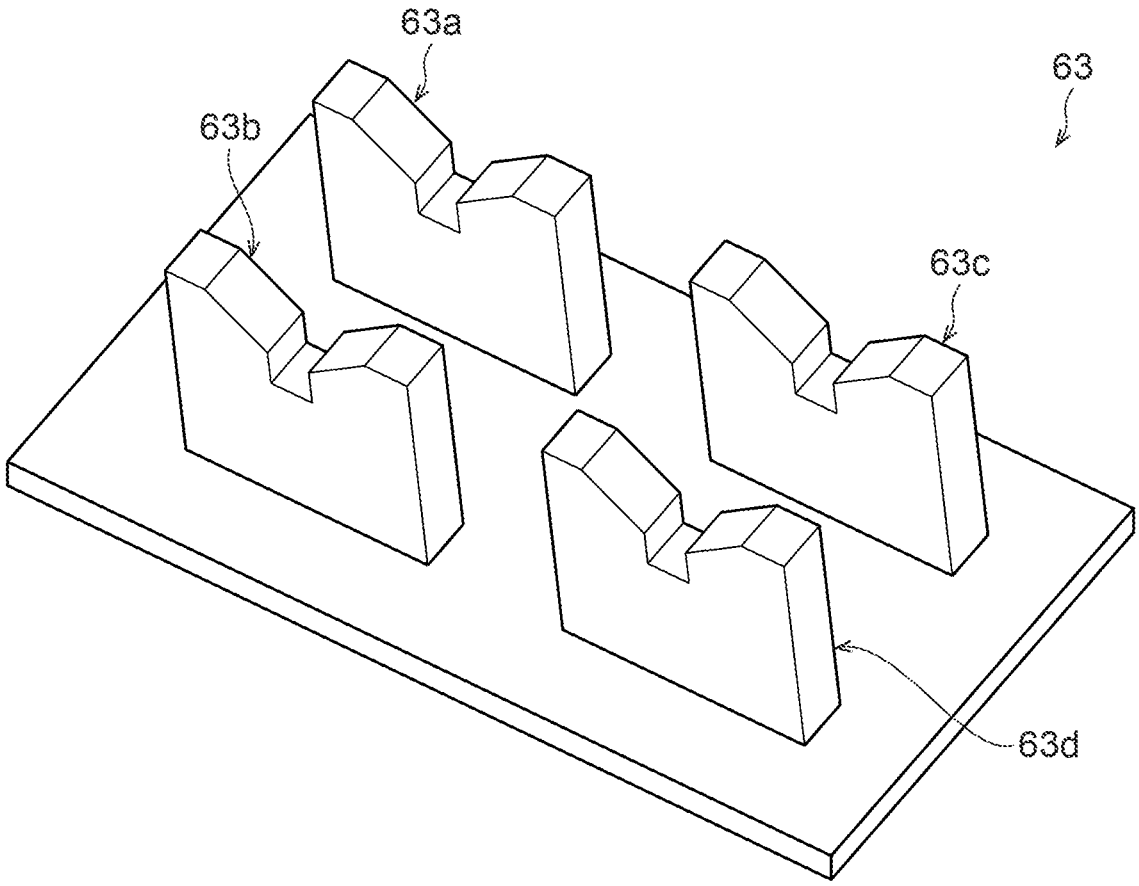
FIG. 5 is a perspective view illustrating a perspective structure of a pallet of the embodiment.

As illustrated in FIG. 5, the first pallet 63 is made of a rectangular plate member and includes grasping parts 63*a* to 63*d*. An upper part of each of the grasping parts 63*a* to 63*d* is formed in a V shape. The grasping parts 63*a* and 63*b* are disposed in a pair in a transverse direction of the first pallet 63. Similarly, the grasping parts 63*c* and 63*d* are disposed in a pair in the transverse direction of the first pallet 63. The pair of grasping parts 63*a* and 63*b* are disposed alongside of the pair of grasping parts 63*c* and 63*d* in a longitudinal direction of the first pallet 63.

As illustrated in FIG. 1, the first pallet 63 is placed on the first conveyer 61 such that the longitudinal direction thereof aligns with a longitudinal direction of the first conveyer 61. The first conveyer 61 reciprocates the first pallet 63 between a position P31 and a position P32 by using motor power. The position P31 is a position facing the mounting-demounting position P22 on the first mold table 41 and is a position at which the first pallet 63 receives casts pulled out from the first pair of molds 81 and 82 or the second pair of molds 83 and 84 on the first mold table 41. The position P32 is a position at a right end part of the first conveyer 61 and is a position at which the robot device 65 takes out a cast placed on the first pallet 63. Hereinafter, the position P31 is referred to as a "receiving position P31", and the position P32 is referred to as a "take-out position P32".

When the first pallet 63 is positioned at the receiving position P31, the first conveyer 61 moves up the first pallet 63 to place, on the first pallet 63, two casts to be pulled out from the first pair of molds 81 and 82 or the second pair of molds 83 and 84 by the removal device 511 of the first unit truck 51. Specifically, one of the two casts is placed on the grasping parts 63*a* and 63*b* of the first pallet 63, and the other cast is placed on the grasping parts 63*c* and 63*d* of the first pallet 63. After the casts are placed on the first pallet 63, the first conveyer 61 moves down the first pallet 63 and then moves the first pallet 63 to the take-out position P32. Thereafter, once the robot device 65 takes the casts out of the first pallet 63, the first conveyer 61 returns the first pallet 63 to the receiving position P31 to prepare for placement of next casts on the first pallet 63.

The second conveyer 62 has the same structure as the first conveyer 61 and the second pallet 64 has the same structure as the first pallet 63, and thus detailed description thereof is omitted.

The robot device 65 is, for example, a six-axis vertical articulated robot, grasps casts placed on the first pallet 63 disposed at the take-out position P32 on the first conveyer 61 and casts placed on the second pallet 64 disposed at the take-out position P32 on the second conveyer 62, and places the grasped casts on a conveyer 100. The casts placed on the conveyer 100 are conveyed to a postprocessing device.

The casting system 10 further includes an outer wall part 150 disposed around the mold tables 41 and 42, the unit trucks 51 and 52, and the conveyance device 60. Shutter units 151 and 152, door units 153 and 154, and an opening 155 are formed at the outer wall part 150.

In the outer wall part 150, the shutter units 151 and 152 are provided at positions facing the mold tables 41 and 42, respectively. The shutter units 151 and 152 are opened and closed based on power of an air cylinder. Specifically, the shutter unit 151 is opened when the molten metal pouring trucks 21 and 22 pour molten metal into the molds 81 to 84, and the shutter unit 151 is closed otherwise. Similarly, the shutter unit 152 is opened when the molten metal pouring trucks 21 and 22 pour molten metal into the molds 91 to 94, and the shutter unit 152 is closed otherwise.

The door units 153 and 154 are used when the worker moves out of and into the outer wall part 150. For example, the molds 81 to 84 and 91 to 94 need to be replaced to change the kind of cast. In such a case, the worker enters inside of the outer wall part 150 through the door unit 153 or 154 and performs work of replacing the molds 81 to 84 or 91 to 94.

The opening 155 is provided so that the robot device 65 can move out casts placed on the pallets 63 and 64 inside the outer wall part 150 to the conveyer 100 outside the outer wall part 150 through the opening 155.

An inner wall part 160 is further provided between the first mold table 41 and the second mold table 42 inside the outer wall part 150. Specifically, a space in which the first mold table 41 is disposed is partitioned from a space in which the second mold table 42 is disposed by the inner wall part 160.

Figure 6:
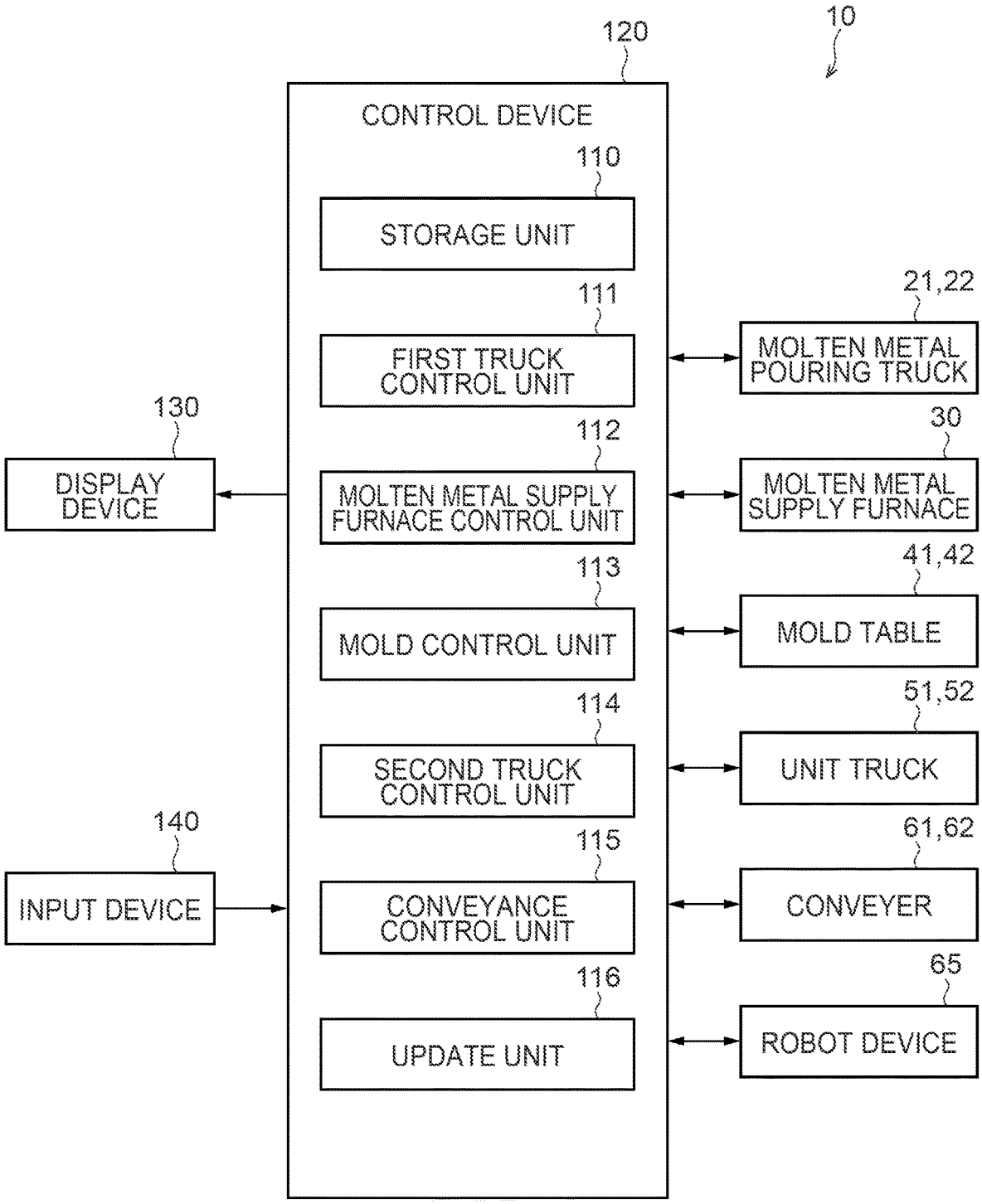
FIG. 6 is a block diagram illustrating a schematic configuration of the casting system of the embodiment.

As illustrated in FIG. 6, the casting system 10 further includes a control device 120, a display device 130, and an input device 140.

The display device 130 has a function to display various images and is, for example, a liquid crystal display or a display lamp.

The input device 140 has a function to receive various operations performed by the worker and is, for example, a mouse, a keyboard, or an operation button.

Note that the display device 130 and the input device 140 may be configured as a touch pad integrally having their functions. Alternatively, the display device 130 and the input device 140 may be configured as combination of a touch pad, a display lamp, an operation button, and the like.

The control device 120 is mainly configured as a microcomputer including a processor, a storage unit 110, and the like. In the present embodiment, the control device 120 corresponds to a control unit. The storage unit 110 is a memory, a hard disk drive (HDD), or the like. For example, a computer program executed by the control device 120 and various cast manufacturing conditions are stored in the storage unit 110. The cast manufacturing conditions include a mold rotational speed, a mold cooling time, and the number of casts need to be manufactured. Note that the cast manufacturing conditions are separately set for casts manufactured on the first mold table 41 and casts manufactured on the second mold table 42. Hereinafter, the manufacturing conditions set for casts manufactured on the first mold table 41 are referred to as "first manufacturing conditions", and the manufacturing conditions set for casts manufactured on the second mold table 42 are referred to as "second manufacturing conditions". The first and second manufacturing conditions are not determined for the mold tables 41 and 42 but are determined for each kind of cast. Products manufactured on the first mold table 41 and the second mold table 42, respectively, may be identical products.

The control device 120 executes a computer program stored in the storage unit 110 in advance, thereby controlling the molten metal pouring trucks 21 and 22, the molten metal supply furnace 30, the mold tables 41 and 42, the unit trucks 51 and 52, the conveyers 61 and 62, and the robot device 65. The control device 120 includes a first truck control unit 111, a molten metal supply furnace control unit 112, a mold control unit 113, a second truck control unit 114, a conveyance control unit 115, and an update unit 116 as functional elements each achieved by executing a computer program stored in the storage unit 110 in advance.

In the casting system 10 of the present embodiment, a user can change the manufacturing conditions of casts manufactured on the mold tables 41 and 42 by changing the first and second manufacturing conditions through an operation of the input device 140. The update unit 116 updates the first and second manufacturing conditions stored in the storage unit 110 based on an operation performed on the input device 140 by the user. Note that the update unit 116 may automatically update the first and second manufacturing conditions based on, for example, a map stored in the storage unit 110 instead of an operation by the user.

The first truck control unit 111 controls the molten metal pouring trucks 21 and 22. Specifically, the first truck control unit 111 repeatedly executes processing illustrated in FIG. 7 in a predetermined period. The following description is made by assuming an initial state in which, for example, the first molten metal pouring truck 21 is operational and the second molten metal pouring truck 22 is waiting. The value of a counter C is initially set to zero.

Figure 7:
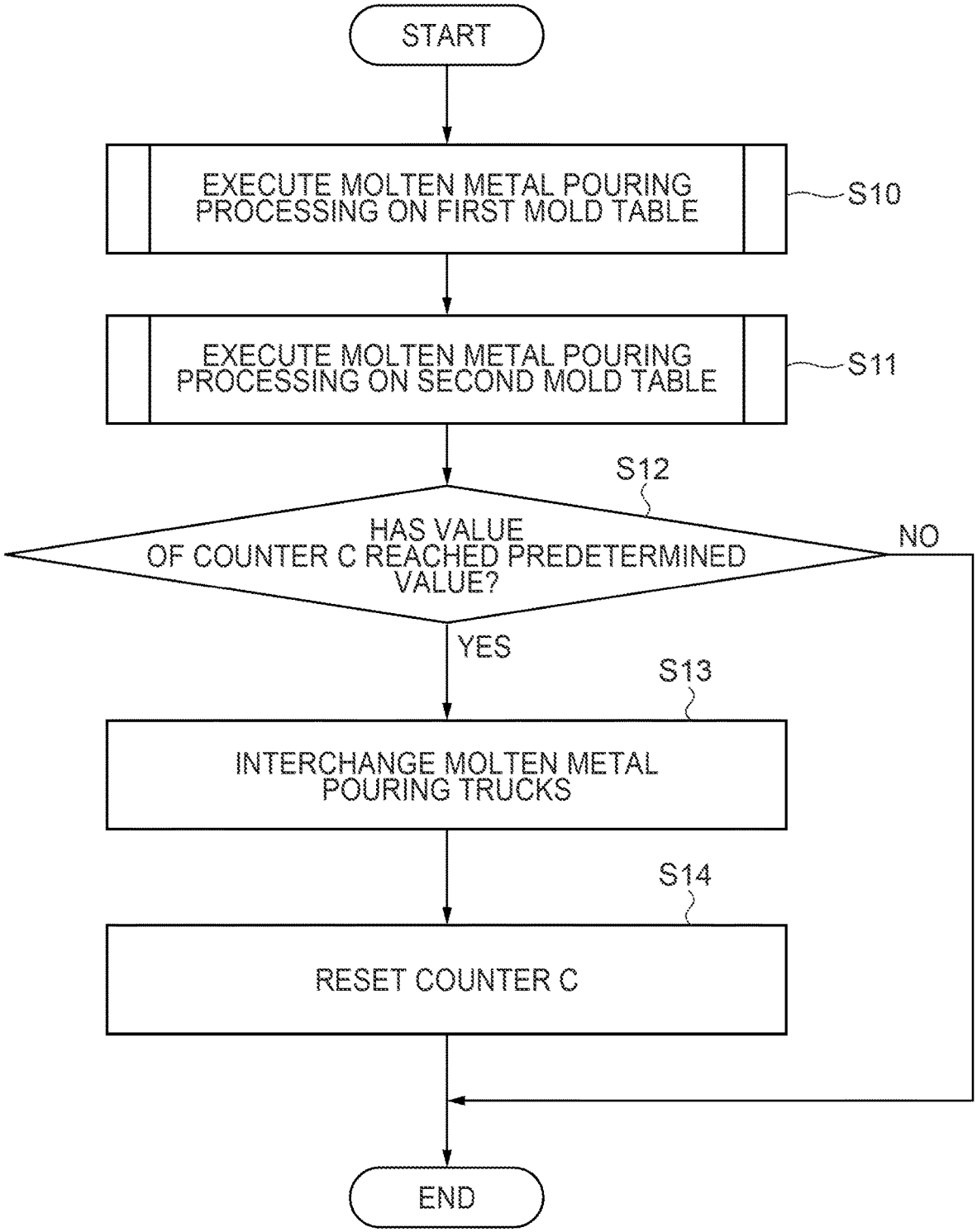
FIG. 7 is a flowchart illustrating the procedure of processing executed by a first truck control unit of the embodiment.

As illustrated in FIG. 7, the first truck control unit 111 first executes molten metal pouring processing on the first mold table 41 (step S10). A specific procedure of the molten metal pouring processing is illustrated in FIG. 8.

Figure 8:
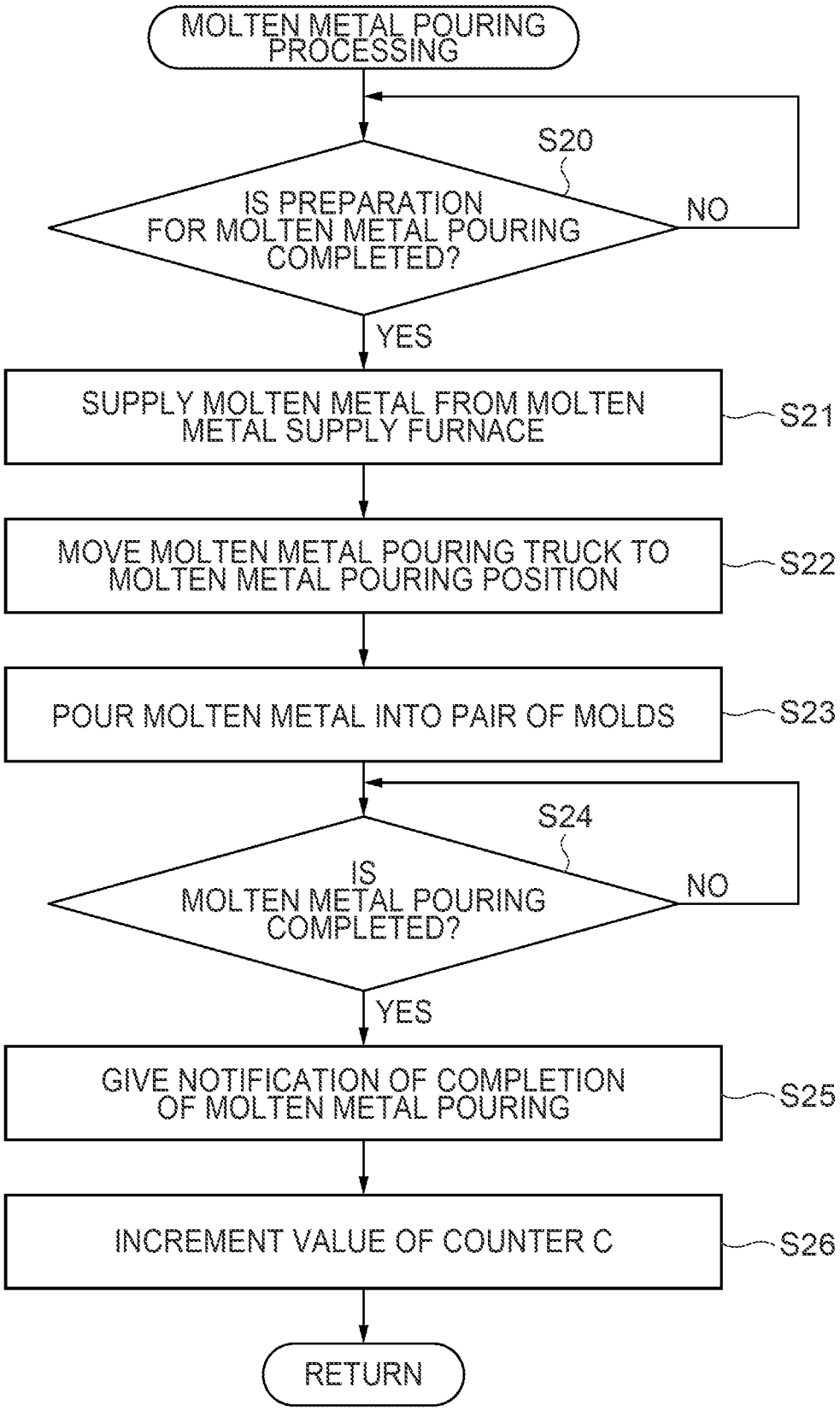
FIG. 8 is a flowchart illustrating the procedure of molten metal pouring processing executed by the first truck control unit of the embodiment.

As illustrated in FIG. 8, in the molten metal pouring processing on the first mold table 41, the first truck control unit 111 first determines whether preparation for molten metal pouring is completed at the first mold table 41 (step S20). For example, when the first pair of molds 81 and 82 or the second pair of molds 83 and 84 are positioned at the molten metal pouring position P21 on the first mold table 41, the first truck control unit 111 determines that preparation for molten metal pouring is completed at the first mold table 41 (YES at step S20). In this case, the first truck control unit 111 supplies molten metal from the molten metal supply furnace 30 to the first molten metal pouring truck 21 (step S21). Specifically, the first truck control unit 111 moves the first molten metal pouring truck 21 to the molten metal receiving position P13. In this case, the first truck control unit 111 moves the first molten metal pouring truck 21 to a first molten metal receiving position at which molten metal can be supplied from the molten metal supply furnace 30 to the one pot part 211*a*, and then moves the first molten metal pouring truck 21 to a second molten metal receiving position at which molten metal can be supplied from the molten metal supply furnace 30 to the other pot part 212*a*. When the first molten metal pouring truck 21 is positioned at the first molten metal receiving position, the molten metal supply furnace control unit 112 drives the molten metal supply furnace 30 to pour molten metal into the one pot part 211*a* of the first molten metal pouring truck 21, and then, when the first molten metal pouring truck 21 is positioned at the second molten metal receiving position, the molten metal supply furnace control unit 112 further drives the molten metal supply furnace 30 to pour molten metal into the other pot part 212*a* of the first molten metal pouring truck 21.

Thereafter, the first truck control unit 111 moves the first molten metal pouring truck 21 to the first molten metal pouring position P12 (step S22), and then drives the spout parts 211*b* and 212*b* of the first molten metal pouring truck 21 to pour molten metal into a pair of molds positioned at the molten metal pouring position P21 on the first mold table 41 (step S23).

Subsequently, the first truck control unit 111 determines whether the molten metal pouring into the pair of molds on the first mold table 41 is completed (step S24), and when having determined that the molten metal pouring into the pair of molds is completed (YES at step S24), the first truck control unit 111 notifies the mold control unit 113 of the completion (step S25) and increments the value of the counter C (step S26). Accordingly, the molten metal pouring processing on the first mold table 41 is completed, and then the first truck control unit 111 returns to the processing illustrated in FIG. 7.

As illustrated in FIG. 7, after the molten metal pouring processing on the first mold table 41 is completed (step S10), the first truck control unit 111 executes the molten metal pouring processing on the second mold table 42 (step S11). Specifically, the first truck control unit 111 executes processing illustrated in FIG. 8 on the second mold table 42. In this manner, the first truck control unit 111 alternately performs molten metal pouring at the first mold table 41 and molten metal pouring at the second mold table 42. The counter C is incremented each time molten metal pouring is performed at the first mold table 41, and is also incremented each time molten metal pouring is performed at the second mold table 42. Accordingly, the value of the counter C is the sum of the number of times of molten metal pouring at the first mold table 41 and the number of times of molten metal pouring at the second mold table 42. In other words, the value of the counter C is the number of times of molten metal pouring by a molten metal pouring truck currently in operational among the first molten metal pouring truck 21 and the second molten metal pouring truck 22.

After having executed the processing at step S11, the first truck control unit 111 determines whether the value of the counter C has reached a predetermined value, in other words, whether the number of times of molten metal pouring by the molten metal pouring truck in operational has reached the predetermined value (step S12). The predetermined value is set to a value with which it can be determined whether maintenance of the pot parts 211*a* and 212*a* and the spout parts 211*b* and 212*b* needs to be performed, and is set to 50, for example. When the value of the counter C has not reached the predetermined value (NO at step S12), the first truck control unit 111 temporarily ends the processing illustrated in FIG. 7.

Thereafter, when the value of the counter C for the first molten metal pouring truck 21 has reached the predetermined value through repetitive execution of the processing illustrated in FIG. 8, the first truck control unit 111 makes positive determination in the processing at step S12 (YES at step S12). In this case, the first truck control unit 111 interchanges the molten metal pouring trucks (step S13). Specifically, the first truck control unit 111 moves the first molten metal pouring truck 21 currently in operational to the first waiting position P11 to wait, and moves the second molten metal pouring truck 22 waiting at the second waiting position P15 to the molten metal receiving position P13. Then, the first truck control unit 111 resets the value of the counter C (step S14) and temporarily ends the processing illustrated in FIG. 7. Subsequently, the first truck control unit 111 executes the processing illustrated in FIG. 7 on the second molten metal pouring truck 22.

The mold control unit 113 illustrated in FIG. 6 controls the mold tables 41 and 42. Note that control performed on the first mold table 41 by the mold control unit 113 and control performed on the second mold table 42 by the mold control unit 113 are substantially identical to each other, and thus the following representative description will be made for the former control.

The mold control unit 113 reads the first manufacturing conditions stored in the storage unit 110 and sets rotational speeds of the roller devices 412 and 413 from information of the mold rotational speed included in the read first manufacturing conditions based on a map, an arithmetic expression, and the like. The mold control unit 113 also sets an opening time of the electromagnetic valve 430 of the cooling device 43 based on the mold cooling time included in the first manufacturing conditions. Specifically, the mold control unit 113 sets a longer opening time of the electromagnetic valve 430 as the mold cooling time is longer. A time in which cooling water is sprayed from the cooling device 43 to molds, in other words, the mold cooling time can be longer as the opening time of the electromagnetic valve 430 is longer.

Figure 9:
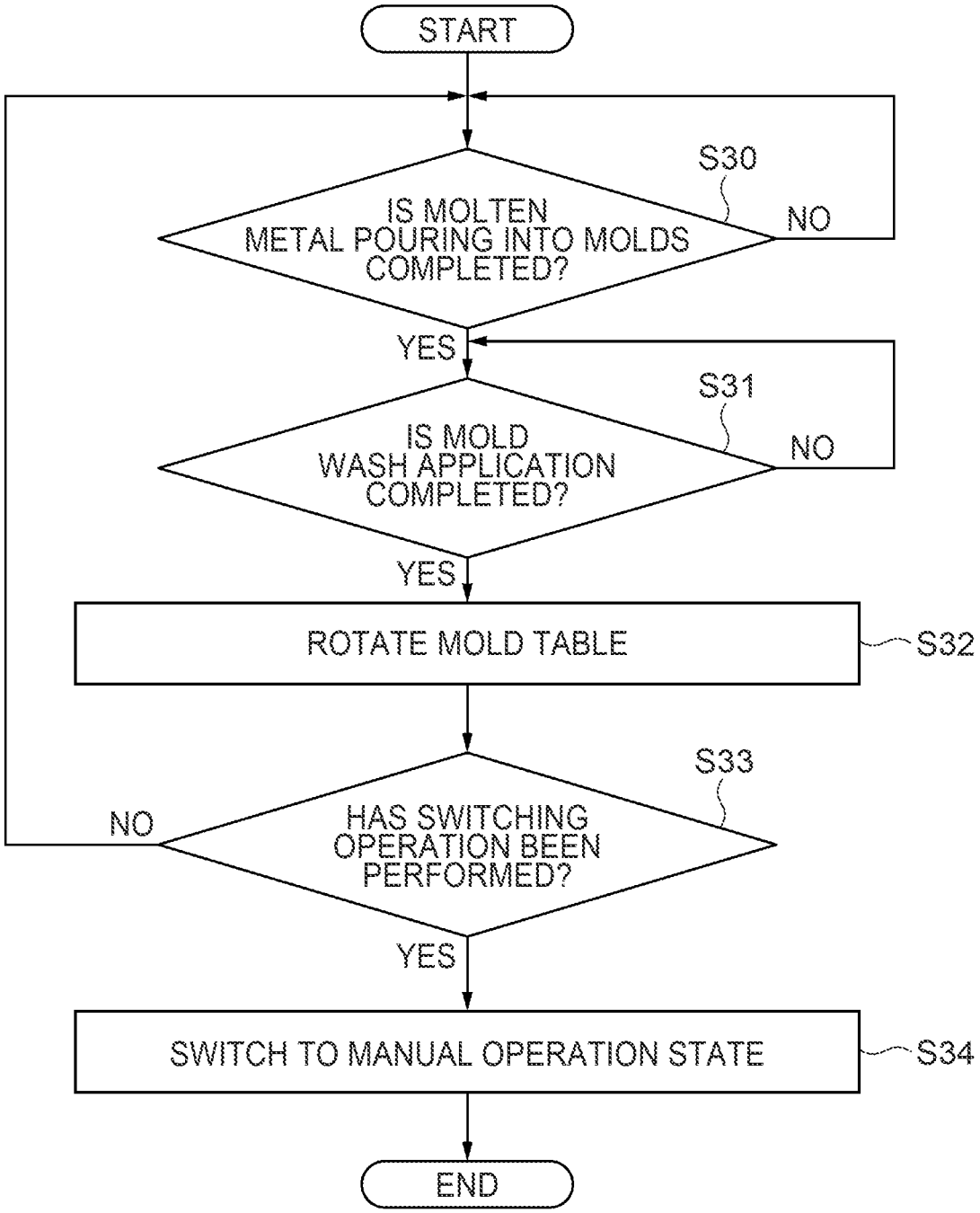
FIG. 9 is a flowchart illustrating the procedure of processing executed by a mold control unit of the embodiment.

The mold control unit 113 also executes processing illustrated in FIG. 9. As illustrated in FIG. 9, the mold control unit 113 first determines whether molten metal pouring into a pair of molds positioned at the molten metal pouring position P21 on the first mold table 41 is completed (step S30). The mold control unit 113 determines that the molten metal pouring into the pair of molds is completed based on reception of a molten metal pouring completion notification transmitted from the first truck control unit 111 (YES at step S30). In this case, the mold control unit 113 determines whether mold wash application to a pair of molds positioned at the mounting-demounting position P22 on the first mold table 41 is completed (step S31). The mold control unit 113 determines that the mold wash application to the pair of molds is completed based on reception of a mold wash application completion notification transmitted from the second truck control unit 114 (YES at step S31). In this case, the mold control unit 113 rotates the first mold table 41 by 180° (step S32). Accordingly, the pair of molds positioned at the molten metal pouring position P21 on the first mold table 41 move to the mounting-demounting position P22, and a pair of molds positioned at the mounting-demounting position P22 moves to the molten metal pouring position P21. Note that the mold control unit 113 rotates the first mold table 41 at a predetermined speed.

Subsequently, the mold control unit 113 determines whether a switching operation from automated operation to manual operation has been performed by a worker (step S33). The switching operation is performed, for example, when the worker presses an operation button of the input device 140. When the switching operation has not been performed (NO at step S33), the mold control unit 113 returns to the processing at step 530. Accordingly, the first mold table 41 automatically rotates so that the first pair of molds 81 and 82 and the second pair of molds 83 and 84 are alternately positioned at the molten metal pouring position P21 and the mounting-demounting position P22.

Thereafter, for example, when the worker determines that setup, maintenance, or the like of the molds 81 to 84 needs to be performed and presses the operation button of the input device 140, the mold control unit 113 determines that the switching operation has been performed in the processing at step S33 (YES at step S33). In this case, the mold control unit 113 switches the operation state of the first mold table 41 from an automated operation state to a manual operation state (step S34) and ends the processing illustrated in FIG. 9. Accordingly, the first mold table 41 can be manually rotated, and thus the worker can perform maintenance of the molds 81 to 84 on the first mold table 41. This maintenance work is performed by moving the first pair of molds 81 and 82 and the second pair of molds 83 and 84 to the maintenance position P23 on the first mold table 41.

Note that the mold control unit 113 resumes the processing illustrated in FIG. 9 when the worker presses the operation button of the input device 140 after having completed setup, maintenance, or the like of the molds 81 to 84. Accordingly, the first mold table 41 automatically rotates again.

The second truck control unit 114 illustrated in FIG. 6 controls the unit trucks 51 and 52. Note that control performed on the first unit truck 51 by the second truck control unit 114 and control performed on the second unit truck 52 by the second truck control unit 114 are identical or similar to each other, and thus the following representative description will be made for the former control. The second truck control unit 114 executes processing illustrated in FIG. 10 when the first pair of molds 81 and 82 or the second pair of molds 83 and 84 on the first mold table 41 are positioned at the mounting-demounting position P22. Note that the following description will be made on an example in which the second pair of molds 83 and 84 are positioned at the mounting-demounting position P22.

Figure 10:
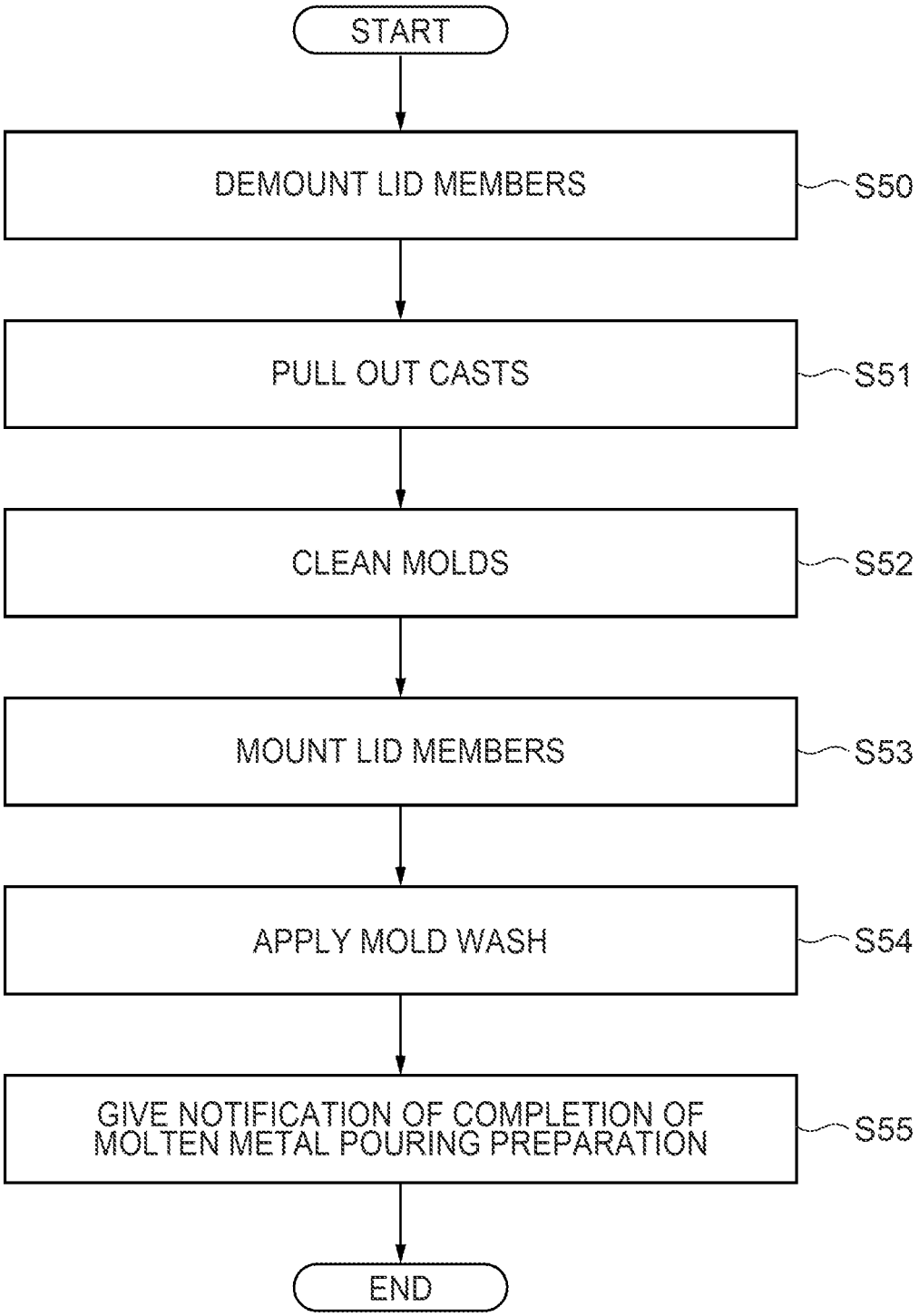
FIG. 10 is a flowchart illustrating the procedure of processing executed by a second truck control unit of the embodiment.

As illustrated in FIG. 10, the second truck control unit 114 first moves the first unit truck 51 so that the mounting-demounting device 510 faces the second pair of molds 83 and 84, and then drives the mounting-demounting device 510 to demount the lid members 830 and 840 from the second pair of molds 83 and 84, respectively (step S50). Subsequently, the second truck control unit 114 sequentially pulls out casts from the molds 83 and 84 by moving the first unit truck 51 so that the removal device 511 sequentially faces the molds 83 and 84 and by driving the removal device 511 (step S51). The casts pulled out by the removal device 511 are placed on the first pallet 63 of the first conveyer 61.

Thereafter, the second truck control unit 114 sequentially cleans the molds 83 and 84 by moving the first unit truck 51 so that the cleaning device 512 sequentially faces the molds 83 and 84 and by driving the cleaning device 512 (step S52). Subsequently, the second truck control unit 114 mounts the lid members 830 and 840 on the molds 83 and 84, respectively, by moving the first unit truck 51 so that the mounting-demounting device 510 faces the second pair of molds 83 and 84 and then by driving the mounting-demounting device 510 (step S53). In addition, the second truck control unit 114 simultaneously applies mold wash to the molds 83 and 84 by moving the first unit truck 51 so that the lining device 513 faces the molds 83 and 84 and by driving the lining device 513 (step S54). When preparation for molten metal pouring into the molds 83 and 84 is completed in this manner, the second truck control unit 114 notifies the first truck control unit 111 of the completion (step S55), and then ends the series of processes illustrated in FIG. 10.

Thereafter, the second truck control unit 114 executes the processing illustrated in FIG. 10 again when the first pair of molds 81 and 82 are positioned at the mounting-demounting position P22.

The conveyance control unit 115 illustrated in FIG. 6 controls the first conveyer 61 and the second conveyer 62. For example, when casts pulled out by the removal device 511 of the first unit truck 51 are placed on the first pallet 63, the conveyance control unit 115 drives the first conveyer 61 to move the first pallet 63 from the receiving position P31 to the take-out position P32. Thereafter, the conveyance control unit 115 transfers the casts on the first pallet 63 to the conveyer 100 by using the robot device 65, and then drives the first conveyer 61 to return the first pallet 63 from the take-out position P32 to the receiving position P31. The conveyance control unit 115 controls the second conveyer 62 in the same manner.

With the casting system 10 of the present embodiment described above, it is possible to obtain operations and effects described in (1) to (9) below.

(1) The casting system 10 includes the plurality of mold tables 41 and 42, the molten metal pouring trucks 21 and 22, and the molten metal supply furnace 30. The centrifugal casting molds 81 to 84 and the centrifugal casting molds 91 to 94 are provided on the mold tables 41 and 42, respectively. The molten metal pouring trucks 21 and 22 can move to the position of each of the mold tables 41 and 42 and pour molten metal into the molds 81 to 84 or 91 to 94 installed on the mold table 41 or 42. The molten metal supply furnace 30 supplies molten metal into the molten metal pouring trucks 21 and 22. With this configuration, one molten metal pouring truck in operational among the molten metal pouring trucks 21 and 22 can pour molten metal into the molds 81 to 84 and 91 to 94 disposed on a plurality of mold tables 41 and 42, respectively, and thus the operation rate of the one molten metal pouring truck can be improved. Accordingly, productivity can be improved.

(2) The casting system 10 further includes the unit trucks 51 and 52 provided for the plurality of respective mold tables 41 and 42. The first unit truck 51 includes the mounting-demounting device 510, the removal device 511, the cleaning device 512, and the lining device 513. With this configuration, the first unit truck 51 can perform mounting and demounting of the lid members 810, 820, 830, and 840 of the molds 81 to 84, cast removal from the molds 81 to 84, cleaning of the molds 81 to 84, and mold wash application to the molds 81 to 84. This is the same for the second unit truck 52. Accordingly, productivity can be further improved.

(3) On each of the mold tables 41 and 42, the plurality of molds 81 to 84 or 91 to 94 are disposed at different positions in the rotational direction of the mold table 41 or 42 such that when the molds 81 and 82 or 91 and 92 are positioned to be able to face the molten metal pouring trucks 21 and 22, the molds 83 and 84 or 93 and 94 different from the molds 81, 82, 91, and 92 can face the unit trucks 51 and 52. Specifically, each of the mold tables 41 and 42 is sandwiched between a movement region of the molten metal pouring trucks 21 and 22 and the unit trucks 51 and 52. On each of the mold tables 41 and 42, the molds 81 to 84 or 91 to 94 are disposed at respective positions shifted by 180° from each other in the rotational direction. With this configuration, while any of the molten metal pouring trucks 21 and 22 pours molten metal into the molds 81, 82, 91, and 92, the unit trucks 51 and 52 can perform various kinds of work on the other molds 83, 84, 93, and 94, and accordingly productivity can be further improved.

(4) The molten metal pouring trucks 21 and 22 each include the plurality of molten metal pouring units 211 and 212 or 221 and 222 that can simultaneously pour molten metal into the first pair of molds 81 and 82 or the second pair of molds 83 and 84, respectively, on the first mold table 41 or into the first pair of molds 91 and 92 or the second pair of molds 93 and 94, respectively, on the second mold table 42. With this configuration, molten metal can be simultaneously poured into each pair of molds by the molten metal pouring units 211 and 212 of the first molten metal pouring truck 21 or by the molten metal pouring units 221 and 222 of the second molten metal pouring truck 22, and accordingly productivity can be further improved.

(5) The casting system 10 further includes the conveyance device 60 configured to convey casts pulled out by the removal devices 511 and 521 of the unit trucks 51 and 52. With this configuration, the casts can be easily conveyed to postprocessing.

(6) The casting system 10 further includes the outer wall part 150 and the inner wall part 160, the outer wall part 150 being provided around the mold tables 41 and 42, the unit trucks 51 and 52, and the conveyance device 60, the inner wall part 160 being provided between the two mold tables 41 and 42 inside the outer wall part 150. With this configuration, worker safety can be easily ensured. Moreover, safety is ensured and thereby, for example, even when maintenance or the like is performed on the first mold table 41, the second mold table 42 partitioned by the inner wall part 160 can be operated, and thus productivity can be improved.

(7) One of the plurality of molten metal pouring trucks 21 and 22 pours molten metal into each of the molds 81 to 84 and 91 to 94 provided on the plurality of mold tables 41 and 42. With this configuration, maintenance or the like can be performed on a molten metal pouring truck not performing work of pouring molten metal into the molds 81 to 84 and 91 to 94. Accordingly, cast shaping can be continuously performed by periodically interchanging a molten metal pouring truck performing work of pouring molten metal into the molds 81 to 84 and 91 to 94 with a molten metal pouring truck on which maintenance is completed.

(8) The casting system 10 further includes the plurality of cooling devices 43 provided opposite the respective mold tables 41 and 42. The cooling devices 43 cool the molds 81 to 84 provided on the first mold table 41 and the molds 91 to 94 provided on the second mold table 42 by cooling water. With this configuration, since cooling of the molds 81 to 84 and 91 to 94 can be performed at the mold tables 41 and 42, productivity can be further improved.

(9) The mold tables 41 and 42 are provided with the roller devices 412, 413, 422, and 423 configured to rotate the molds 81 to 84 and 91 to 94. The casting system 10 further includes the control device 120 configured to control the rotational speeds of the roller devices 412, 413, 422, and 423. With this configuration, for example, the rotational speeds can be controlled for each of the molds 81 to 84 and 91 to 94, more specifically, for each pair of molds, and thus multiple kinds of casts can be manufactured.

Note that the above-described embodiment may be performed in forms described below.

The number of molds installed on the mold tables 41 and 42 is changeable as appropriate. At least one mold may be installed on the mold tables 41 and 42.

Each of the unit trucks 51 and 52 does not need to include all of the mounting-demounting device 510 or 520, the removal device 511 or 521, the cleaning device 512 or 522, and the lining device 513 or 523, respectively, but only needs to includes at least one of them.

The casting system 10 is not limited to two mold tables but may include three mold tables or more.

A control device configured to control the molten metal supply furnace 30 and a control device configured to control the molten metal pouring trucks 21 and 22 and the like except for the molten metal supply furnace 30 may be individually provided at the control device 120.

The first pair of molds 81 and 82 and the second pair of molds 83 and 84 on the first mold table 41 may be disposed at, for example, positions shifted by 45° from each other instead of positions shifted from each other by 180°. This is the same for the second mold table 42.

The present disclosure is not limited to the above-described specific examples. Those obtained by adding designing change to the above-described specific examples as appropriate by the skilled person in the art are also included in the scope of the present disclosure as long as they have the features of the present disclosure. Elements included in the above-described specific examples, and their disposition, conditions, shapes, and the like are not limited to those exemplarily described but may be changed as appropriate. Combination of elements included in the above-described specific example may be changed as appropriate without technological inconsistency.

What is claimed is:

1. A casting system comprising:

a plurality of mold tables on each of which at least one centrifugal casting mold is provided;

a molten metal pouring truck that moves to a position of each of the plurality of mold tables and pours molten metal into the mold installed on each mold table;

a molten metal supply furnace that supplies molten metal to the molten metal pouring truck and;

a plurality of cooling devices configured to cool the molds provided on the mold tables, wherein the mold tables are rotatable, and the molten metal pouring truck travels on a straight rail.

2. The casting system according to claim 1, further comprising a plurality of unit devices provided for the plurality of respective mold tables, wherein each of the unit devices includes at least one of a mounting-demounting unit configured to perform mounting and demounting of a lid member mounted at an end part of each of the molds, a removal unit configured to pull out a cast shaped inside the mold from the mold, a cleaning unit configured to clean the mold, and a lining unit configured to apply mold wash to the mold.

3. The casting system according to claim 2, wherein the mold tables are rotatable, and on each of the mold tables, a plurality of the molds are disposed at different positions in a rotational direction of the mold table such that when a certain mold is positioned to be able to face the molten metal pouring truck, a mold different from the certain mold faces the unit devices.

4. The casting system according to claim 3, wherein each of the mold tables is sandwiched between a movement region of the molten metal pouring truck and a corresponding one of the unit devices, and on each of the mold tables, the molds are disposed at respective positions shifted by 180° from each other in the rotational direction.

5. The casting system according to claim 2, wherein on each of the mold tables, a plurality of the molds are disposed at respective different positions in the rotational direction, and the molten metal pouring truck includes a plurality of molten metal pouring units that simultaneously pours molten metal into the plurality of respective molds.

6. The casting system according to claim 2, further comprising a conveyance device configured to convey casts pulled out by the removal units of the unit devices.

7. The casting system according to claim 6, further comprising:

an outer wall part provided around the mold tables, the unit devices, and the conveyance device; and an inner wall part provided between the plurality of mold tables inside the outer wall part.

8. The casting system according to claim 1, comprising a plurality of the molten metal pouring trucks, wherein one of the plurality of molten metal pouring trucks pours molten metal into each of the molds provided on the plurality of mold tables.

9. The casting system according to claim 1, wherein the plurality of cooling devices are provided opposite the plurality of respective mold tables.

10. The casting system according to claim 1, wherein the mold tables are provided with roller devices configured to rotate the molds, and the casting system further includes a control unit configured to control rotational speeds of the roller devices.

* * * * *